United States Patent [19]

Roeder

[11] Patent Number: 4,544,335

[45] Date of Patent: Oct. 1, 1985

[54] PISTON AND VALVE ASSEMBLY

[76] Inventor: George K. Roeder, P.O. Box 4335, Odessa, Tex. 79760

[21] Appl. No.: 648,121

[22] Filed: Sep. 7, 1984

[51] Int. Cl.[4] ..... F04B 47/08

[52] U.S. Cl. ..... 417/401; 91/224; 91/321; 417/403; 417/407

[58] Field of Search ..... 417/399, 401, 402, 403, 417/404; 91/224, 321

[56] References Cited

U.S. PATENT DOCUMENTS

| | | | |
|---|---|---|---|
| 2,497,348 | 2/1950 | Ecker | 417/403 |
| 3,865,516 | 2/1975 | Roeder | 417/403 |
| 4,026,661 | 5/1977 | Roeder | 417/401 X |
| 4,118,154 | 10/1978 | Roeder | 417/402 |

*Primary Examiner*—Leonard E. Smith
*Attorney, Agent, or Firm*—Marcus L. Bates

[57] ABSTRACT

A downhole hydraulically actuated pump assembly of either the free or fixed type lifts formation fluid from the bottom of a borehole to the surface of the ground. The downhole pump has a power piston which actuates a production plunger. A valve means is concentrically arranged within the power piston. A stationary, hollow valve control rod extends through the power piston and through the valve means, with a lower marginal end of the control rod terminating within the production plunger. Power fluid flows through the control rod and to the valve means. As the power piston reciprocates within the engine cylinder, means on the control rod actuates the valve means between two alternant positions so that power fluid is applied to the bottom face of the power piston to thereby cause the power piston to reciprocate upward; and thereafter, the control rod causes the valve means to shift to the other position, whereupon spent power fluid is exhausted from the engine cylinder. The spent power fluid is admixed with production fluid and is conducted to the surface of the ground.

15 Claims, 9 Drawing Figures

PISTON AND VALVE ASSEMBLY

BACKGROUND OF THE INVENTION

The present invention constitutes an improvement over my copending patent application Ser. No. 416,996 filed Sept. 13, 1982, to which reference is made for further background. It is often desirable to have made available a hydraulically actuated downhole pump assembly which can be designed in a manner whereby the power piston and production plunger reciprocate an unusually long stroke. It is also desirable that such a pump assembly require a minimum of moving parts, thereby greatly extending the life of the pump because there are fewer parts subject to malfunction. It is further desirable to have a long stroking pump assembly which utilizes the power fluid for lifting the power piston uphole as the production plunger makes the suction stroke, and thereafter, utilizes the stored energy of the produced fluid for returning the power piston in a downhole direction while concurrently forcing the production plunger to make a power stroke.

The present invention provides a new downhole hydraulically actuated pump of either the free or fixed type which achieves the above desirable goals, and at the same time overcomes many of the disadvantages found in similar downhole pumps. A downhole pump made in accordance with the present invention has an unexpected long life because of the novel features associated therewith.

SUMMARY OF THE INVENTION

This invention relates to downhole pumps and specifically to a downhole hydraulically actuated pump assembly having a main body within which a power chamber and a production chamber are formed. A power piston and production plunger, respectively, are affixed to one another and are reciprocatingly received within the power and production chambers, respectively. A valve means includes a valve control rod and a sliding sleeve which are concentrically arranged with respect to one another and axially aligned with respect to the power piston and pump plunger. The control rod is affixed to the main body of the pump and therefore, stationary respective to the power piston and pump plunger. As the power piston reciprocates, the control rod causes power fluid and spent power fluid to shift the valve sleeve between two alternant positions.

In one of the two alternate positions of operation, power fluid flows through the control rod, back up to the sleeve, and then below the power piston, thereby forcing the power piston to stroke uphole. Towards the end of the upstroke, the control rod causes the sleeve to shift to its other position, whereupon spent power fluid is exhausted from below the power piston to the area above it and flows into the wellbore where it is admixed with production fluid and forced to the surface of the ground.

In one embodiment of the invention, the pump plunger suction stroke occurs during the uphole reciprocation. In another embodiment of the invention, the pump plunger suction stroke occurs during the downhole reciprocation.

The assembled pump comprises a sleeve which reciprocates within the power piston and moves respective to the control rod and piston. The power piston and production plunger move respective to the main body and the control rod. The only other moving parts found in the pump assembly are the production valves associated with the production end of the pump. The length of the stroke of the power piston and production plunger is therefore limited to the length of the power chamber, production chamber, and control rod.

A primary object of the present invention is the provision of a downhole hydraulically actuated pump assembly of either the fixed or free type which has an unusually limited number of moving parts.

Another object of the invention is the provision of a downhole pump which can be provided with an unusually long stroke.

A further object of this invention is the provision of a downhole pump which utilizes power fluid for effecting the upstroke and which utilizes produced fluid for effecting the downstroke.

A still further object of this invention is the provision of a single acting downhole pump having a valve assembly located within the power piston thereof which is controlled by a fixed hollow control rod, wherein the control rod extends axially through the power piston and valve means.

Still another object of this invention is to provide an improved pump of lower energy requirements as compared to my previous Pat. No. 3,703,926 which requires more power fluid to operate than this new improved pump.

Another object of this invention is to provide a downhole pump assembly of a type which advantageously utilizes a stationary pilot valve rod in a new and unusual manner.

Still a further object of this invention is to provide an improved pump assembly having a space formed within the production plunger thereof which receives a stationary pilot valve rod during the upward movement of the plunger.

And yet a further object of this invention is to provide a compact hydraulically actuated pump assembly with the greatest stroke movement possible.

Another object of this invention is to provide a downhole pump assembly with a stroke action, all of which is contained within the main pump housing, so that nothing extends from the pump assembly during operation thereof.

A still further object of this invention is to provide a means for removing the valve assembly from the uppermost end of a downhole pump assembly, with the power fluid flow through the valve assembly being arranged so that at start up of the pump, foreign particles are precluded from passing through the engine valve assembly thereof.

Another object of this invention is to provide an improved pump assembly designed in a manner whereby increasing the size of the production plunger reduces the power fluid requirements of the pump engine.

An additional object of the present invention is to provide a downhole pump assembly with a power fluid packoff sleeve having equalizing ports formed therein to allow the hydrostatic fluid to flow back and forth within the production chamber at a location above the production piston and thereby allow the use of a production piston which is of equal area to the engine piston valve assembly.

Another object of the invention is to provide a pump engine with a spiral groove inside the main valve thereof to prevent the valve from ever locking on center, thus assuring positive starts without the necessity of bumping or jarring the pump up and down against the lower end of the bottom hole assembly as presently required by some prior art hydraulic pumps.

These and other objects and advantages of the present invention will become readily apparent to those skilled in the art upon reading the following detailed description and claims and by referring to the accompanying drawings.

The above objects are attained in accordance with the present invention by the provision of a combination of elements which are fabricated in a manner substantially as described in the present disclosure.

DETAILED DESCRIPTION OF THE PREFERRED EMBODIMENTS

Figure 1:
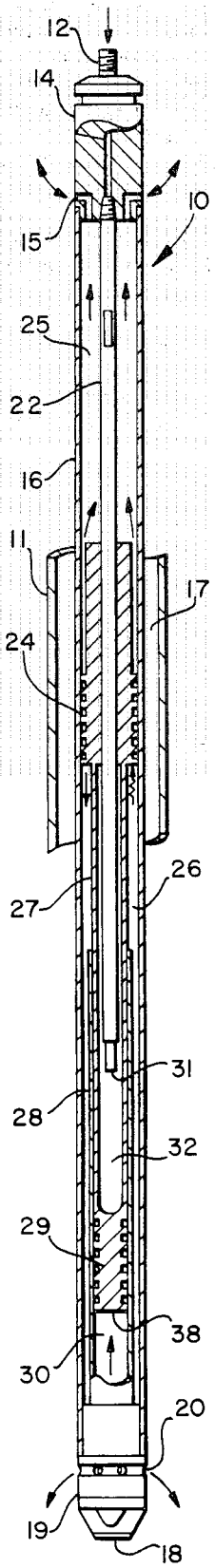
FIG. 1 is a diagrammatical, part schematical, part longitudinal, cross-sectional view of a downhole pump made in accordance with the present invention.

FIG. 1 broadly discloses a hydraulically actuated downhole pump assembly 10 for use downhole in a cased borehole 11. The pump apparatus 10 can be either the fixed or free type. A power fluid inlet 12 is formed at the upper end 14 of the pump assembly. Breather ports 15 are formed at the illustrated elevated location of the main body 16 of the pump.

Annulus 17 is formed between the casing 11 and the main body 16 of the pump. Formation fluid inlet 18 is formed at the lower end 19 of the pump assembly 10. Produced fluid outlet 20 is formed at the lower marginal end of the pump and at a location above inlet 18 so that the lower end 19 of the pump assembly can be made into a shoe or the like for being seated in sealed relationship downhole in a borehole in a manner known to those skilled in the art, and as particularly set forth in my previous U.S. Pat. Nos. 3,915,595; 3,957,400; 4,293,283; and 4,118,154.

A hollow control rod 22 is mounted in a stationary manner respective to the main body 16 of the pump. The hollow control rod 22 lies along the longitudinal central axis of the main body 16.

The interior of the upper marginal end portion of the main body is in the form of an engine cylinder which reciprocatingly receives a combination valve and piston assembly 24. The valve and piston assembly 24 divides the interior of the upper marginal end of the main body 16 into an upper non-working or hydrostatic chamber 25 and a lower working or engine chamber 26. A reduced diameter production plunger 27 downwardly extends from attached relationship respective to the piston, and is received within the illustrated reduced diameter production cylinder 28. Hence, the plunger 27, together with the production cylinder 28 forms a production working chamber 30 through which formation fluid from 18 is received and thereafter forced to flow through production outlet ports 20.

The before mentioned fixed control rod 22 extends all of the way through the central axis of power piston 24 and terminates below the piston as an open ended rod at 31, so that power fluid which is supplied at power fluid inlet 12 is effected within the blind passageway which forms the hollow interior 32 of the plunger 27, and thereby provides the force to move or stroke the piston and plunger assembly.

Throughout the various figures of the drawings of this disclosure, like or similar numerals will be employed for indicating like or similar elements of the pump assembly of this invention.

Figure 2:
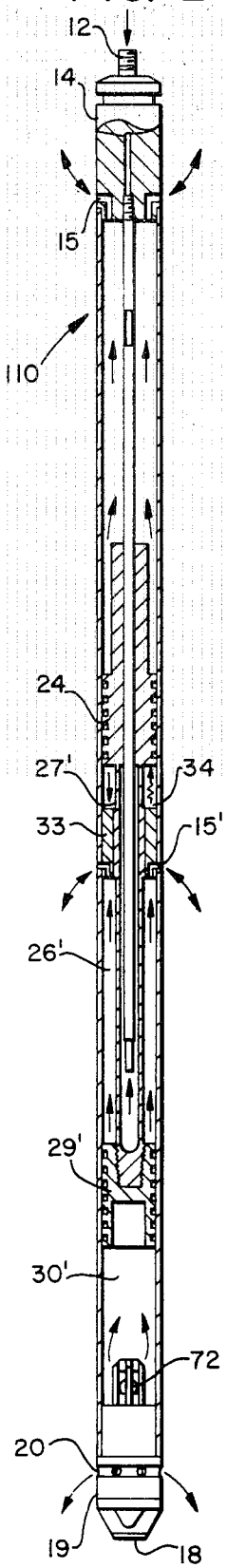
FIG. 2 is similar to FIG. 1 and shows another embodiment of the invention.

In the second embodiment of the invention disclosed in FIG. 2, packer 33 sealingly receives the reduced diameter piston part 27', thereby separating the before mentioned annular lower engine chamber into chambers 34 and 26', wherein chamber 34 is the engine working chamber while chamber 26' is open to the well fluid located externally of the main body 16' by means of lower breather ports 15'. The construction of the embodiment of FIG. 2 is substantially identical above packer 33 with respect to FIG. 1. However, the production end, that is the part of the pump assembly lying below packer 33, is of different construction in order that a greater volume of production can be achieved with a larger diameter piston 29'. In FIG. 2, production piston 29' is reciprocatingly received within production working chamber 30', which also is of maximum diameter. The bottom shoe 19 and check valves associated therewith are somewhat different than the production check valves associated with the first embodiment of the invention, as will be more fully appreciated later on in this disclosure, especially in view of FIGS. 4 and 5.

Figure 3:
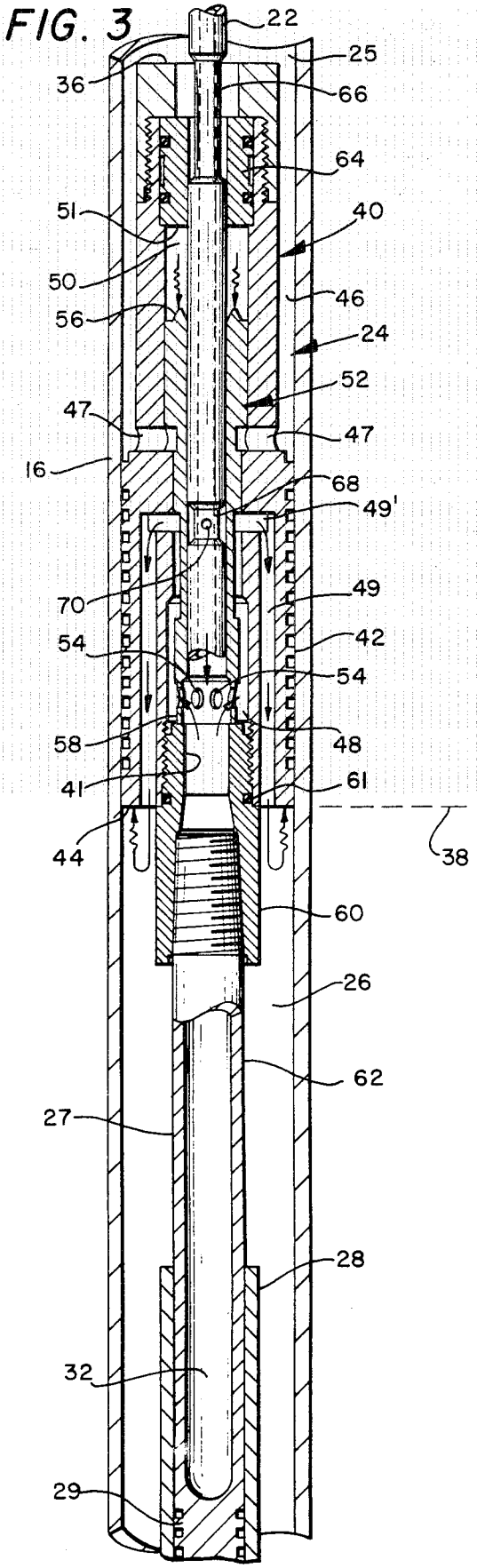
FIG. 3 is an enlarged, fragmentary, part cross-sectional view of part of the pump disclosed in FIG. 1.

FIG. 3 discloses additional details of the first preferred embodiment of the invention, wherein it will be noted that the combination power fluid control valve and engine piston 24 terminates at the upper end thereof in an apertured cap 36. Numeral 38 indicates a dot-dash line which is considered the lower end of the combination valve and piston assembly. The arrow at numeral 40 indicates the main body of the power oil valve assembly. An axial passageway 41 extends through the entire piston and valve assembly. An engine piston 42 in the form of a sleeve is reciprocatingly received in sealed relationship respective to the power chamber formed on the interior of the main pump body. The piston terminates at lower end 44. The piston 42 separates the upper annulus 46 from the lower annulus or engine working chamber 26.

Power fluid exhaust ports 47 communicate with annulus 46, which communicates with the upper hydrostatic chamber 25. Annulus 48 communicates with annulus 49 by means of the illustrated ports 49'.

A valve chamber 50 is an annular area formed between the interior of the main valve body and the exterior of the control rod. The valve chamber 50 extends from upper end 51 thereof down to the lower end of annulus 48. A valve sleeve 52 is reciprocatingly received within the valve chamber, which also is an axial bore formed through the combination valve and piston assembly. Ports 54 are an optional detail of design which may be formed near the lower terminal end of the valve sleeve, as illustrated, while the upper end 56 of the sleeve preferably is provided with a number of very small standoffs or radially spaced protrusions for abuttingly engaging upper end 51 of chamber 50. The lower end 58 of the valve sleeve 52 abuttingly engages the upper annular face of adaptor 60. The adaptor 60 is removably affixed in a rigid manner to the lower end of the main body of the combination valve and power piston 40. Seal means, such as an o-ring 61, can be interposed where desired to seal the interface between adaptor 60 and the lower end 44 of the piston.

A production plunger has an extension 62 which threadedly engages the lower end of adaptor 60 and extends downhole in axial aligned relationship respective to the pump main body and terminates in a reciprocating manner within the before mentioned production cylinder 28.

Removal of the upper rod seal 64 from the upper end of the main body 40 of the valve and piston assembly provides access to the valve sleeve 52. The valve sleeve 52 is provided with a spiral groove 53 (shown in FIG. 6) to prevent the traveling valve sleeve from locking on center, thus assuring positive starts and avoiding the necessity of using extraneous means by which the valve sleeve is forced off center as is sometimes required in some prior art engines. The groove 53, over an extended period of time, will permit a small flow of fluid across the grooves of the valve sleeve, when the sleeve is locked on center, thereby moving the sleeve to the end of its stroke whereupon the pumping action can continue. The spiral groove, during normal pumping action, acts as a seal so that an insignificant flow of fluid occurs thereacross.

The relative location of the control rod, valve sleeve, and upper rod sleeve provides a chamber 50 which is isolated from debris which may accumulate above the upper rod sleeve, and may otherwise contaminate the valve section of the engine. Any accumulation of debris will be translocated into lower interior 32 of the plunger, or else the debris will be of a density to be forced from the engine during the operation thereof. This unforseen advantage gained by the flow path associated with the engine of this invention imparts an unexpected longer life into the downhole pump 10.

Figure 6:
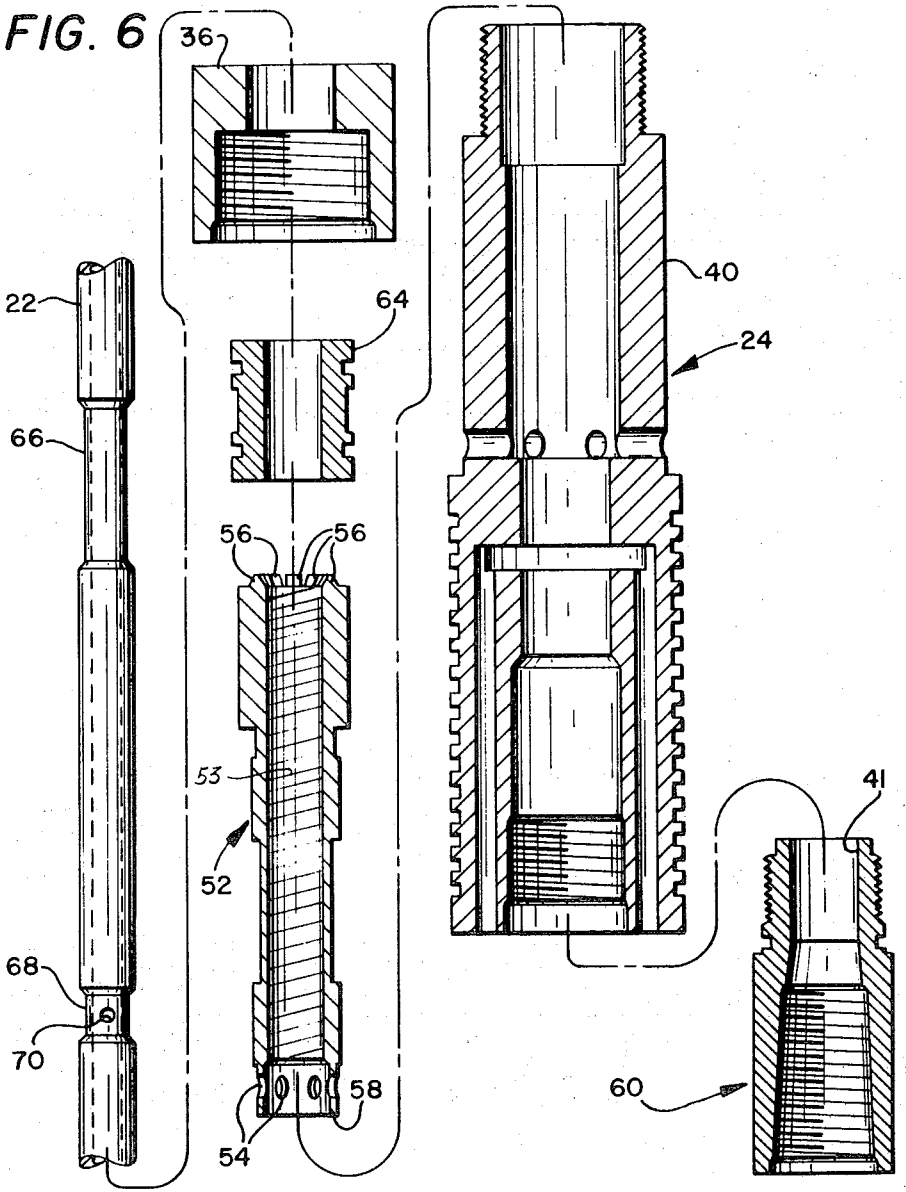
FIG. 6 is an exploded view of part of the pump apparatus disclosed in FIG. 3.

In FIG. 6, together with other figures of the drawings, it will be noted that the upper rod seal 64 forms the before mentioned abutment 40 against which the upper end 56 of the traveling valve sleeve is received. The control rod 22 has upper and lower flats, 66 and 68, respectively, formed thereon, with the lower control flat being ported at 70. The distance between flats 66, 68 is selected in accordance with the desired stroke of the combination piston and valve assembly 24.

Figure 4:
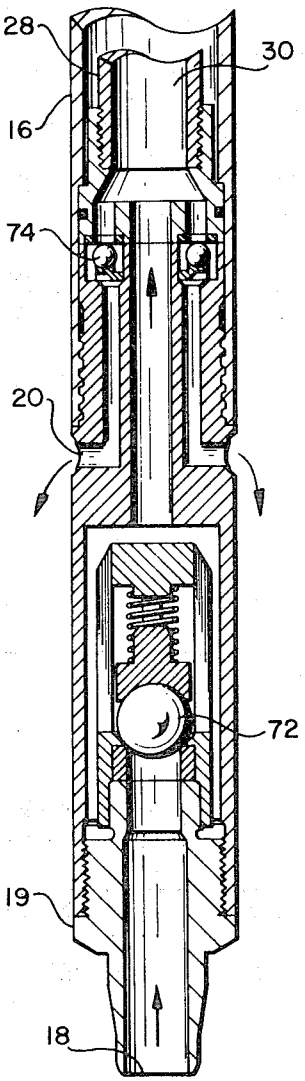
FIG. 4 is a fragmentary, longitudinal, part cross-sectional view showing the production end of the pump apparatus disclosed in FIG. 1.

In FIG. 4, an intake check valve 72 is spring loaded into the normally closed position and admits formation fluid to flow from inlet 18, through the valve assembly, and into the before mentioned production working chamber 30 where the action of the plunger 29 forces fluid contained within chamber 30 through the radially spaced apart check valve 74 so that produced fluid exits at the before mentioned production outlet 20.

Figure 5:
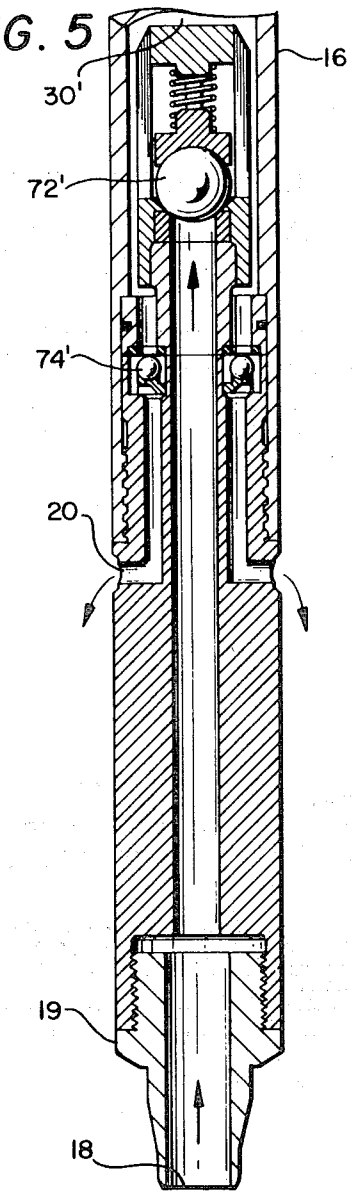
FIG. 5 is a fragmentary, longitudinal, part cross-sectional view which illustrates the production end of the embodiment of the invention disclosed in FIG. 2.

In the valve assembly of FIG. 5, the intake valve 72' permits fluid to flow from formation inlet 18 into the production working chamber 30' whereupon the action of piston 29' forces fluid to flow through the radial check valve 74' and to the outlets 20.

The check valve assembly of FIG. 4 is for use with the embodiment disclosed in FIG. 1, while the check valve assembly of FIG. 5 is for use in conjunction with the embodiment of FIG. 2.

Figure 7:
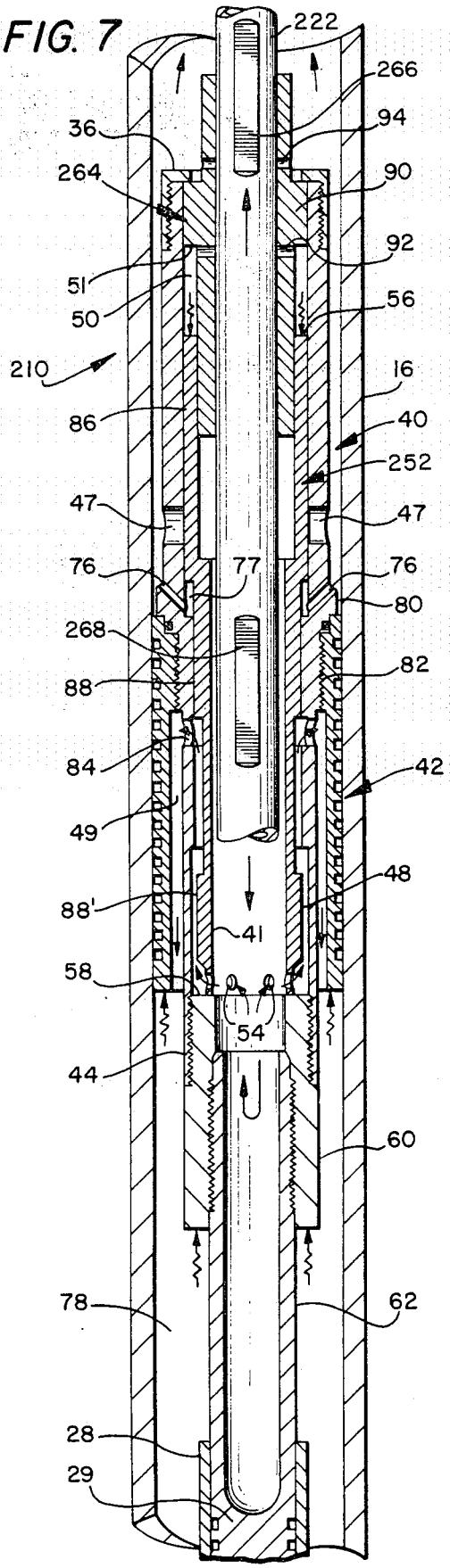
FIGS. 7 and 8 are broken, longitudinal, cross-sectional views of another embodiment of the invention, with FIG. 7 showing the pump apparatus thereof during the upstroke while FIG. 8 discloses the pump apparatus during the downstroke; and, FIG. 9 is an exploded detailed view which discloses some parts of the apparatus seen disclosed in FIGS. 7 and 8.
Figure 8:
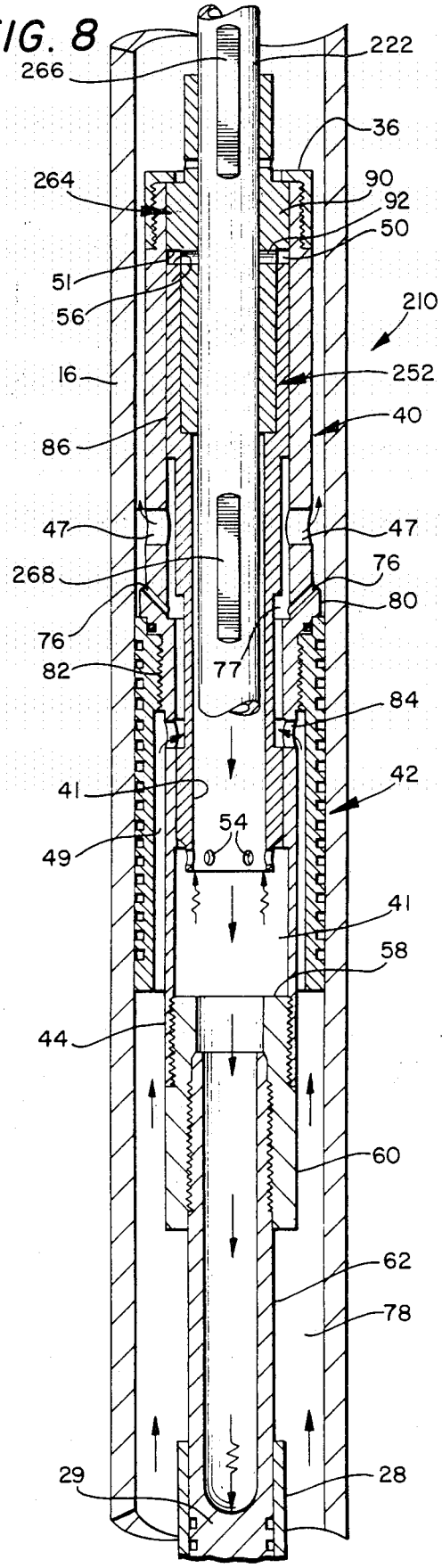

In the embodiment of the invention set forth in FIGS. 7 and 8, control sleeve 264 forms annulus 50 about the exterior thereof within which the upper marginal end of valve sleeve 252 reciprocates, noting the position of the sleeve during the upstroke and downstroke; respectively, in FIGS. 7 and 8, respectively. Release ports 76 are formed through the main body 40 and prevent hydraulicing of chamber 77. Annulus 78 is formed between the production plunger and the interior of the main body.

Figure 9:
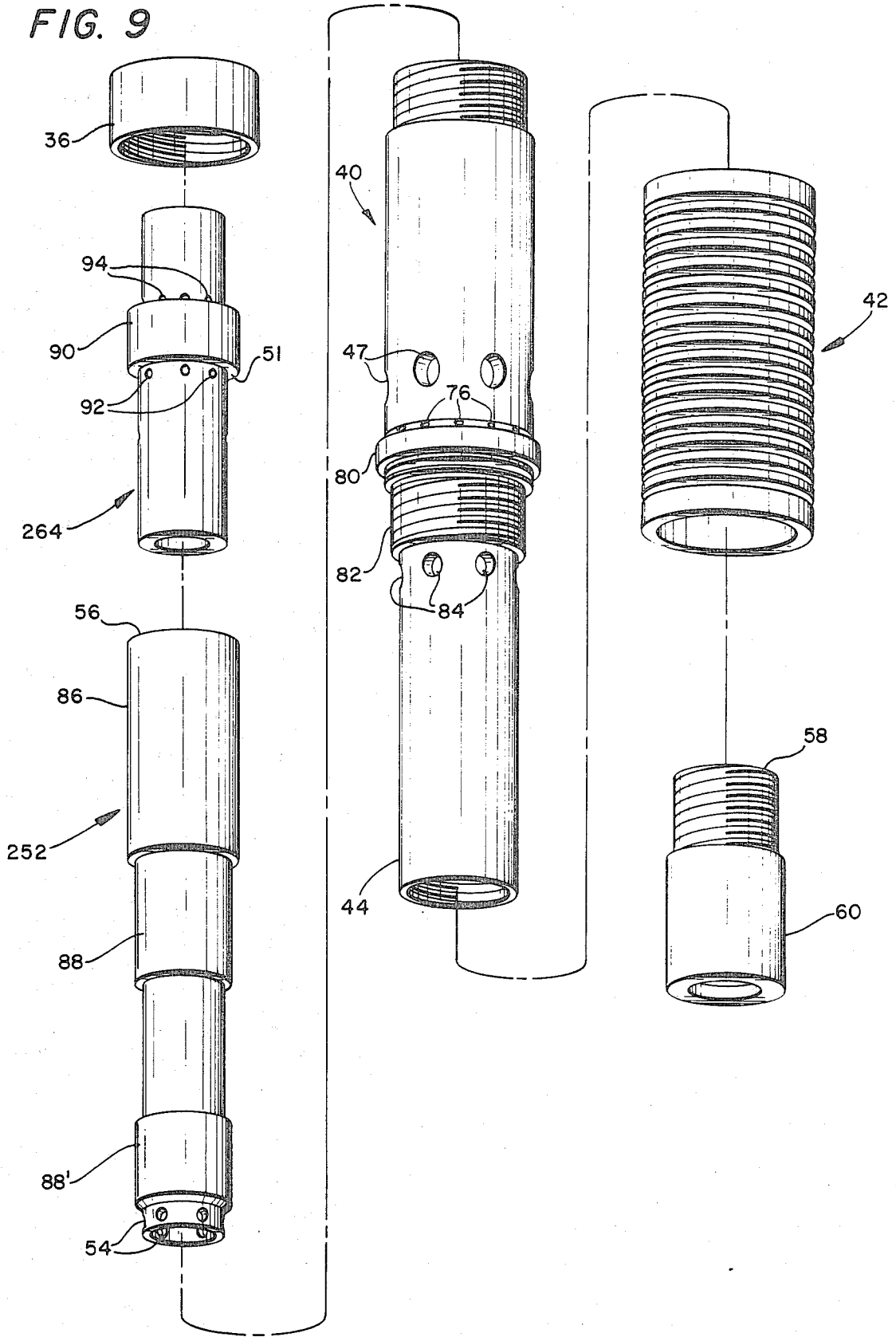

As best seen in FIG. 9, together with other figures of the drawings, a boss 80, located on the main body of the valve, provides a shoulder against which the threadedly attached engine piston 42 abuttingly engages. Inlet and discharge ports 84 are located below threads 82.

The valve sleeve 52 or 252 includes a large bearing seal at spaced apart small bearing seals 88, 88'. The control sleeve 264 is enlarged at a medial portion thereof to form a boss 90, with there being actuating ports 92 and pressure release ports 94, respectively, formed on opposed sides of the boss 90.

While various components of the downhole hydraulically actuated pump are shown as being removably affixed to one another, it should be understood that many of the assembled parts can be made of unitary construction, however it is preferred to divide the various parts of the pump into the illustrated various different members as seen in FIG. 9 for ease of assembly, repair, and fabrication. For example, it is possible to fabricate the engine piston and valve body from one piece of material, if desired to do so. In any event, the assembled engine is comprised of a main body which forms the engine and production cylinders, a combination valve and piston reciprocatingly received thereon and directly connected to a pump plunger, with there additionally being a valve control sleeve; and accordingly, it will be appreciated that the assembled pump of the present invention has an unusually small number of moving parts which provides the downhole pump assembly with an unexpected long life.

The present invention provides a novel downhole pump assembly which includes a simplified, novel, valve assembly for use on subsurface pumps for lifting formation fluid to the surface of the earth. The pump assembly of the present invention is more economical to fabricate than many other more complicated hydraulically actuated pumps of the prior art, and the utilization of longer sealing surfaces provide greater sealing area and thereby considerably add to the life as well as the performance of the hydraulic pump assembly disclosed herein for the reason that the valve assembly is always the heart of any downhole hydraulically actuated pump, and by extending the life of the valve assembly, a similar longevity is realized from the other pump components.

In the various different figures of the drawings, and in particularly FIGS. 7 and 8, it previously was noted that the valve is in the form of a sleeve 252 which circumferentially extends about the control rod and reciprocates respective thereto. Therefore, it should be appreciated that the friction drag on the interior surface of the valve sleeve 252 provides a force which urges the valve to assume its proper position of operation. That is, the valve sleeve is down as the piston valve assembly moves uphole, and the valve sleeve is biased up as the piston valve assembly moves downhole. This is an important feature of this invention. A tapered bumper area is located on the large end of the valve sleeve and assures that the larger area of the valve sleeve continues to remain in the necessary position as the upper end of the valve sleeve abuttingly engages the face 51 of the control sleeve 264; that is, as the upper end 56 of the valve sleeve abuttingly engages the circumferentially extending shoulder 51 located on the control sleeve 264.

An unusual feature found in the present invention is the absence of ports and apertures that usually are formed through the wall of the control sleeve, as well as the lack of numerous parts which are usually required to make up an operative piston valve assembly. Hence, the present invention has very few moving parts as may be found in most other comparable hydraulically actuated pump assemblies.

The combination engine piston and valve assembly of this invention can be utilized in a number of different hydraulically actuated pumps, in addition to the various different combinations exemplified by the drawings illustrative of the preferred embodiments of the present invention. The piston used herein is illustrated as being connected to a hollow connecting tube 62, referred to herein as the extension of a production plunger.

It is believed within the comprehension of this invention to provide flow passageway means on the outside of the well tubing from the area above the pump to the tubing seal member, and also to a lower seal member for supplying power fluid along a flow path exterior of the power cylinder and into the area below the power piston as contrasted to supplying the pump engine through the pilot rod. Hence, in this modification, the pilot rod need not be of the hollow type; however, a significant amount of the lower end of the pilot valve rod can be made hollow in order to allow fluid flow to the chamber above the large area of the main valve. Further, it is possible to employ either flats, 266 and 268, as shown in FIG. 7, or grooves, 66 and 68, as shown in FIG. 6, as may be desired.

The production fluid from the production end may be flow connected to a common production exhaust chamber in order to allow the production fluid to flow from the production chamber, into the common production exhaust chamber, and then uphole to the surface. Accordingly, the utilization of separate strings of tubing and casing can be employed to provide power fluid flow down one string of tubing to the power end of the pump and spent power fluid can exhaust or return up a separate string of tubing to provide a flow path to the surface, thereby allowing the use of a closed circuit power fluid system, if such an expedient is deemed desirable. A separate string of tubing or other means forming a separate flow path can be advantageously employed for allowing the production fluid to flow from the common production exhaust chamber and up to the surface. This arrangement allows the realization of a reduction in the operating power pressure for the system, and further provides a safety factor for obtaining additional production fluid. Other additional advantages and unexpected results may be appreciated by those skilled in the art as this disclosure is more fully digested.

OPERATION

In the embodiment of FIGS. 1 and 2, power fluid is supplied by the usual surface power source (not shown) under suitable pressure and is conducted down the inside of a power tubing 11 to the hydraulic subsurface pump of this invention. Power fluid enters the upper end 12 of the free type packer nose mandrel and flows down through the o-ring seal member and continues down through the interior of the stationary pilot valve rod 22. The power fluid continues down into the hollow portion of the production plunger 29, which forms the power chamber 32. The power chamber 32 constantly maintains a high pressure level of power fluid for driving the engine, and is available on both the up and down stroke.

During the upstroke, high pressure power fluid is forced to flow from the power chamber and upward into the inlet pressure ports 54 of the main valve, around the lower small bearing surface of the valve sleeve 52, out the inlet pressure ports 49' of the valve, and downward at 49 to a location below the piston, whereupon the high pressure provides an upward force to the bottom side of the combination traveling engine piston and valve assembly. This action provides a pressure differential across the piston and forces the piston of the engine to move upward, pulling the production plunger upward, thus operating a pressure differential or vacuum below the plunger, while sucking in the formation fluid up through the production intake valve 72 and into the production chamber 30 located below the production plunger 29. The valve 52 or 252 is in the lowermost position of FIG. 7 at this time.

This upward movement of the engine piston and valve assembly also forces the spent power or exhaust fluid trapped above the traveling engine piston and valve assembly to flow out of the exhaust or discharge chamber 25 by way of ports 15 formed in the o-ring seal member 14 located at the uppermost portion of the subsurface pump.

As the traveling engine piston reaches the upper end of its stroke, the top flat 66 or 266 of the pilot valve rod forms a fluid passageway between the pressure release port of the control sleeve and the actuating part of the control sleeve, thereby relieving the pressure that was previously trapped above the enlarged portion of the valve 52. Fluid pressure acts on the small area of the valve 52, forcing it to reciprocate upward to the uppermost position, such as seen in FIG. 8, for example. This action opens up the discharge ports 47 in the valve body and closes off the passageway around the lower small bearing surface of the main valve by means of a seal portion found on the lower inside portion of the valve body.

The valve 52, now positioned at the upper end of its stroke movement, allows the spent power fluid located below the piston assembly and within the working chamber 26 to flow through the valve assembly and into the area 25 above the piston assembly along flow paths 78, 49, 84, 77, 47, (FIG. 8); 46, 25, 15 (FIGS. 1 and 3). This movement is made possible because of the high pressure which is always effected within the power chamber 32 of the production plunger 27, which provides a force to the lower inside area of the production plunger. The area available for the downward force to act on is equal to the area of the pilot rod end.

During this downward movement of the plunger 29, formation fluid within the variable chamber 30 of the production cylinder and below the production plunger 29 is forced out through the exhaust check valves 74 or 74' since the intake check valve 72 is closed at the end of the upstroke. The formation fluid is therefore forced to flow through the exhaust valve means, away from the pump, and upward to the surface as produced fluid which is subsequently admixed with spent power fluid from ports 15.

As the piston and valve assembly reaches the lowermost end of the downward stroke, the bottom flat 68 is aligned with the high pressure power fluid and the actuating port, thus allowing high pressure power fluid to flow into the area above the upper large area end of the valve. The force provided by the larger area overcomes the force presented on the small area end of the main valve, and the valve is thereby forced to move downward until the lower end of the valve makes contact with the valve stop adaptor and is arrested. The valve is now positioned for the upstroke. This reciprocating motion continues so long as power fluid is conducted to the pump assembly.

I claim:

1. A hydraulically actuated pump assembly for producing fluid from a formation located downhole in a borehole, said pump assembly has a main body, a power piston, a pump plunger affixed to said power piston;

means forming said main body into a power chamber and a production chamber; said power piston and pump plunger, respectively, are reciprocatingly arranged in slidable sealed relationship within said power chamber and production chamber, respectively; said power piston divides said power chamber into upper and lower power chambers;

a stationary control rod axially aligned respective to the piston and plunger, a valve means including a valve control sleeve, means by which said sleeve is reciprocatingly received within said piston and concentrically arranged respective to said control rod;

means on said control rod for causing said sleeve to reciprocate within said piston between a first and a second alternant position of travel in response to reciprocation of the power piston; means by which said sleeve, when moved to the first alternate position, forms a flow passageway extending through the control rod, through the valve means, and into the lower chamber, thereby causing the power piston to stroke in one direction;

means on said control rod for causing said sleeve to be moved to the second alternate position, and thereby form a flow passageway extending from said lower power chamber, through said valve means and out of said main body in response to said piston having reciprocated in the recited one direction;

a formation fluid inlet, a production valve means, a produced fluid outlet, and passageway means by which fluid flows through said production valve means into the production chamber and out of said main body;

whereby said sleeve is shifted into the first alternant position when said piston upstrokes, and said sleeve is shifted into the second alternant position when said piston downstrokes, and power fluid is thereby applied to said piston to cause the piston and plunger to upstroke, and thereafter, the spent power fluid is exhausted from the pump assembly on the piston downstroke.

2. The pump assembly of claim 1 wherein an axial passageway extends through said piston and into proximity of said plunger;

said control rod has a lower terminal end which terminates within said axial passageway so that power fluid is always effected within said axial passageway.

3. The pump assembly of claim 2 wherein breather port means are provided for connecting said upper power chamber to the well hydrostatic head;

the production valve means and the engine valve means are positioned respective to the power piston and plunger piston whereby the plunger produces fluid on the downstroke in response to the hydrostatic head being effected on the upper face of the power piston.

4. The pump assembly of claim 1 wherein said plunger produces fluid on the downstroke and thereafter is reciprocated uphole due to the power fluid being effected on the power piston.

5. The pump assembly of claim 1 wherein said upper power chamber is a hydrostatic chamber with the hydrostatic chamber being located above the lower power chamber, flow passageway means formed through said main body and into the hydrostatic chamber so that hydrostatic fluid can always be effected within said hydrostatic chamber.

6. The pump assembly of claim 1 wherein a passageway means is connected whereby the upper end of the power chamber is in communication with the hydrostatic fluid of a borehole and hydrostatic fluid is therefore always effected on the upper end of the power piston;

while power fluid is effected on the lower end of the piston during the upstroke.

7. A downhole hydraulically actuated pump assembly comprising a main body within which there is formed an engine chamber and a production chamber; an engine piston reciprocatingly received within said engine chamber and dividing said engine chamber into a hydrostatic chamber and a power chamber; passageway means formed through said main body through which fluid can flow into and out of said hydrostatic chamber in response to reciprocation of said engine piston;

a pump plunger reciprocatingly received within said production chamber, means connecting said plunger to said piston to impart reciprocal movement into said plunger, production inlet valve means by which formation fluid can flow into said production chamber, production outlet valve means by which produced fluid can be forced from said production chamber;

a control rod means axially aligned with said engine piston and said hydrostatic chamber, said control rod is stationary respective to said main body, a valve sleeve concentrically arranged respective to said control rod, means mounting said valve sleeve within said piston for reciprocation between two alternant positions in response to the relative location of the control rod respective to the piston;

means forming a first flow path which extends axially through said control rod, through said valve sleeve, and into said power chamber whereby power fluid effected within said control rod forces said piston to stroke uphole when said sleeve is in one alternate position; means forming a spent power fluid flow path which extends from said power chamber into said piston, through said valve sleeve and into said hydrostatic chamber so that spent power fluid can be exhausted from said power chamber when said valve sleeve is in the other alternant position;

whereby power fluid forces said piston to stroke uphole and thereafter hydrostatic pressure forces said piston to stroke downhole, thereby reciprocating said plunger and causing formation fluid to flow through said production chamber in response to reciprocal action of said pump plunger.

8. The pump assembly of claim 7 wherein an axial passageway extends through said piston and into proximity of said plunger;

said control rod has a lower terminal end which terminates within said axial passageway so that power fluid is always effected within said axial passageway.

9. The pump assembly of claim 8 wherein the production valve means and the engine valve means are positioned respective to the power piston and plunger piston whereby the plunger produces fluid on the downstroke in response to the hydrostatic head being effected on the upper face of the power piston.

10. The pump assembly of claim 7 wherein said plunger produces fluid on the downstroke and thereafter is reciprocated uphole due to the power fluid being effected on the power piston.

11. The pump assembly of claim 7 wherein said production plunger divides the production chamber into a lower production chamber and an upper hydrostatic chamber with the last said hydrostatic chamber being located above the lower production chamber, flow passageway means formed through said main body and into the last said hydrostatic chamber so that hydrostatic fluid is always effected within the last said hydrostatic chamber.

12. The pump assembly of claim 7 wherein a passageway means is connected whereby the upper end of the power chamber is in communication with the hydrostatic fluid of a borehole and hydrostatic fluid is therefore always effected on the upper end of the power piston;

while power fluid is effected on the lower end of the piston during the power stroke.

13. A single action long stroking hydraulically actuated downhole pump having a main body within which there is formed a cylindrical bore; an engine and a pump plunger reciprocatingly received within the cylindrical bore; said piston and plunger being spaced apart and rigidly connected to one another in axially aligned relationship respective to one another and to the main body cylindrical bore;

said plunger having opposed faces and forming part of said cylindrical bore into a production chamber, a blind passageway formed through said piston which terminates in spaced relationship respective to one face of the plunger, a valve control rod axially aligned respective to said piston and plunger, said rod terminates in spaced relationship respective to the blind end of the blind passageway;

a valve sleeve reciprocatingly received within said engine, means by which the sleeve is urged to reciprocatingly move into one of two alternate positions in response to relative movement between the piston and the control rod;

said piston divides the cylindrical bore into a power chamber and a hydrostatic chamber, flow passageway means by which well fluid can flow into and out of said hydrostatic chamber thereby effecting a hydrostatic force on one end of the piston; passagway means extending through the control rod, into an annulus formed between the control rod and the blind passageway, into said sleeve, through part of the piston, and into said power chamber whereby said sleeve is moved into one alternant position to cause power fluid to flow into the power chamber and force the piston to stroke uphole;

means forming an exhaust passageway from said power chamber into said piston, into said sleeve, and through said piston to said hydrostatic chamber so that spent power fluid can flow from said power chamber, through said piston, into said hydrostatic chamber, where spent power fluid can exit the pump main body and co-mingle with production fluid and flow to the surface of the earth;

inlet and outlet check valve means associated with said production chamber by which formation fluid is forced to flow into said production chamber, through the outlet check valve, and uphole to the surface of the earth.

14. The pump of claim 13 wherein a passageway means is connected whereby the upper end of the power chamber is in communication with the hydrostatic fluid of a borehole and hydrostatic fluid is therefore always effected on the upper end of the piston;

while power fluid is effected on the lower end of the piston during the power stroke.

15. The pump of claim 13 wherein said control rod has a lower terminal end which terminates within said blind passageway so that power fluid is always effected within said blind passageway;

wherein the production valve means and the engine valve means are positioned respective to the power piston and plunger piston whereby the plunger produces fluid on the downstroke in response to the hydrostatic head being effected on the upper face of the power piston.

* * * * *